US007942982B2

(12) United States Patent
Kubo et al.

(10) Patent No.: US 7,942,982 B2
(45) Date of Patent: May 17, 2011

(54) GRAIN-ORIENTED ELECTRICAL STEEL SHEET EXCELLENT IN COATING ADHESION AND METHOD OF PRODUCING THE SAME

(75) Inventors: Yuji Kubo, Tokyo (JP); Eiichi Nanba, Tokyo (JP); Satoshi Arai, Tokyo (JP); Hotaka Honma, Tokyo (JP); Kazumi Mizukami, Tokyo (JP); Koki Tanaka, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 12/312,427

(22) PCT Filed: Nov. 15, 2007

(86) PCT No.: PCT/JP2007/072600

§ 371 (c)(1),
(2), (4) Date: May 7, 2009

(87) PCT Pub. No.: WO2008/062853

PCT Pub. Date: May 29, 2008

(65) Prior Publication Data

US 2010/0055481 A1 Mar. 4, 2010

(30) Foreign Application Priority Data

Nov. 22, 2006 (JP) ..... 2006-315527

(51) Int. Cl.
*H01F 1/147* (2006.01)

(52) U.S. Cl. ..... 148/113; 148/111; 148/308

(58) Field of Classification Search ..... None
See application file for complete search history.

(56) References Cited

U.S. PATENT DOCUMENTS

| | | | | |
|---|---|---|---|---|
| 4,775,430 | A * | 10/1988 | Tanaka et al. | 148/113 |
| 5,885,371 | A * | 3/1999 | Komatsubara et al. | 148/113 |
| 2009/0047537 | A1 | 2/2009 | Nanba et al. | |

FOREIGN PATENT DOCUMENTS

| | | |
|---|---|---|
| GB | 1563853 | 4/1980 |
| JP | 40-15644 | 7/1965 |
| JP | 53-4714 | 1/1978 |
| JP | 57-2252 | 1/1982 |
| JP | 58-2569 | 1/1983 |
| JP | 60-141830 | 7/1985 |
| JP | 61-015152 | 1/1986 |

(Continued)

OTHER PUBLICATIONS

International Search Report dated Feb. 12, 2008 issued in corresponding PCT Application No. PCT/JP2007/072600.

*Primary Examiner* — John P Sheehan
(74) *Attorney, Agent, or Firm* — Kenyon & Kenyon LLP

(57) ABSTRACT

Grain-oriented electrical steel sheet excellent in coating adhesion is provided. The steel sheet contains Si: 2 to 7% mass % and has a primary coating composed mainly of forsterite on its surface. A compound (A) containing one or more elements selected from among Ca, Sr and Ba, at least one rare earth metal, and sulfur is incorporated in the primary coating so as to reside in the interface layer between the primary coating and the steel sheet. As a result, occurrence of primary coating exfoliation at regions that are strongly worked during manufacture of a wound core transformer or the like is prevented.

6 Claims, 4 Drawing Sheets

FOREIGN PATENT DOCUMENTS

| | | |
|---|---|---|
| JP | 61-015152 | 4/1986 |
| JP | 06-088171 | 3/1994 |
| JP | 6-192743 | 7/1994 |
| JP | 08-295937 | 11/1996 |
| JP | 09-118921 | 5/1997 |
| JP | 2005-264280 | 9/2005 |
| WO | WO 2006/126660 | 11/2006 |

* cited by examiner

GRAIN-ORIENTED ELECTRICAL STEEL SHEET EXCELLENT IN COATING ADHESION AND METHOD OF PRODUCING THE SAME

FIELD OF THE INVENTION

This invention relates to grain-oriented electrical steel sheet for use in transformers and other stationary induction apparatuses. It particularly relates to high magnetic flux density grain-oriented electrical steel sheet imparted with excellent transformer manufacturing properties by reducing coating exfoliation rate during strong bending.

DESCRIPTION OF THE RELATED ART

Grain-oriented electrical steel sheet is chiefly used in stationary induction apparatuses, typically transformers. The properties required by grain-oriented electrical steel sheet include, for example: 1) low loss of energy under AC excitation, i.e., low core loss, 2) easy excitation owing to high permeability in the excitation range in which the apparatus is used, and 3) low in noise-causing magnetostriction.

The first-mentioned property 1) is particularly critical because a transformer is continuously excited and continues to lose energy over many years between installation and scrapping. Core loss is therefore an important parameter determining T.O.C. (Total Owning Cost), which is an index of transformer value.

Many technologies have been developed for reducing the core loss of grain-oriented electrical steel sheet. These include: 1) increasing {110}<001> orientation (so-called Goss orientation) density, 2) increasing content of Si and other solute elements that enhance electrical resistance, 3) reducing sheet thickness, 4) providing a ceramic, insulation or other coating that imparts surface tension to the sheet, 5) reducing crystal grain size, and 6) refining magnetic domains by introducing linear strain and/or grooves.

A classic example of a technology for improving magnetic flux density is the production method taught by Japanese Patent Publication (B) No. S40-15644. This method causes AlN and MnS to function as inhibitors for inhibiting crystal grain growth and sets the reduction ratio in final cold rolling at a strong reduction of greater than 80%. The method increases the density of crystal grain orientation in the {110}<001> direction to realize a grain-oriented electrical steel sheet having high magnetic flux density whose $B_8$ (flux density at excitation force of 800 A/m) is 1.870 T or greater.

As a technology for further improving the magnetic flux density, Japanese Patent Publication (A) No. H6-88171, for example, teaches a method of adding 100 to 5,000 g/ton of Bi to the molten steel to obtain a product with a $B_8$ of 1.95 T or greater.

On the other hand, various methods have been developed for reducing core loss by magnetic domain refinement, including a method of subjecting the steel sheet to laser treatment (Japanese Patent Publication (B) No. S57-2252) and a method of introducing mechanical strain into the steel sheet (Japanese Patent Publication (B) No. S58-2569). And steels exhibiting excellent core loss property are also disclosed.

Japanese Patent Publication (A) No. S60-141830 teaches a method of producing grain-oriented silicon steel sheet by adding to an annealing separator composed mainly of MgO one or more of additives selected from among La, La compounds, Ce, and Ce compounds in a total amount as La and Ce compounds of 0.1 to 3.0% based on the amount of MgO and adding S or S compounds in an amount of 0.01 to 1.0% as S based on the amount of MgO. This is a method of improving magnetic properties by using an annealing separator containing the inhibitor-forming element S and allowing S to pass from the annealing separator to penetrate the steel during finish annealing, thereby strengthening the action of inhibiting grain growth during primary recrystallization and the action of controlling the orientation of secondary recrystallization grains growing from the surface layer. It is directed to making the timing of S penetration optimum for the secondary recrystallization by causing La and Ce, which have a strong affinity for S, to be co-present with S.

Further, Japanese Patent Publication (B) No. S61-15152 teaches an annealing separator for grain-oriented silicon steel strip using magnesium oxide as a base material. The annealing separator is characterized by including a rare earth oxide alone or together with a metal silicate. It further teaches that the annealing separator makes it possible to obtain a product free of small discontinuities (small recessed holes) below the skin of the strip, thereby achieving low magnetostriction, good surface resistivity and good adhesion.

SUMMARY OF THE INVENTION

Although the prior art methods discussed above have made it possible to obtain grain-oriented electrical steel sheet exhibiting excellent core loss property as a raw material, they do not solve the problem of peeling of the primary coating during strong inward bending in the course of manufacturing a transformer, particularly a wound core transformer, using the grain-oriented electrical steel sheet. This is a problem that still requires solving in order to industrially manufacture the high-efficiency transformers demanded by the market.

The primary coating adhesion of the strongly bent region is determined by wrapping the steel sheet around a round bar of 10 mm or smaller diameter and is expressed as the coating exfoliation area rate defined as the ratio of the area where coating exfoliation occurred to the worked area of the steel sheet in contact with the round bar.

Japanese Patent Publication (A) No. S60-141830 referred to earlier is not directed to improving coating adhesion by enhancing coating performance. This publication therefore offers little information regarding coating adhesion. It merely states that bending adhesion deteriorates when the total amount of La and Ce added to the annealing separator exceeds 3.0 mass % of the MgO and is totally silent regarding the level of the steel sheet bending adhesion. Of particular note is that it does not mention or even suggest anything about adhesion at the strongly bent region (the exfoliation area rate during strong bending). Moreover, the steel slab composition set out in the publication does not include Al, which is effective for realizing high magnetic flux density and nothing is said about the effect of Al, which markedly affects the exfoliation area rate during strong bending.

Further the aforesaid Japanese Patent Publication (B) No. S61-15152 is also not directed to improving coating adhesion by enhancing coating performance and makes no mention of steel composition anywhere in the description, including that of the examples.

The inventors earlier reported that adding a Ce compound or La compound, or both a Ce compound and an La compound, to an annealing separator composed chiefly of MgO makes it possible to obtain a grain-oriented electrical steel sheet containing Ce or La, or both Ce and La, in the primary coating and that the primary coating of this steel sheet is excellent in coating adhesion, particularly in "frame peeling"

property. However, the coating adhesion is still insufficient in terms of the adhesion of the primary coating at strongly bent regions.

The object of the present invention is to overcome the aforesaid problem by providing a grain-oriented electrical steel sheet excellent in coating adhesion that is capable of preventing occurrence of peeling of the primary coating at regions strongly bent toward the inner side of a transformer core in the course of manufacturing a transformer, particularly a wound core transformer, and to provide a method of producing the same.

In order to achieve this object, the invention provides grain-oriented electrical steel sheet and a production method thereof as set out in the following.

(1) Grain-oriented electrical steel sheet excellent in coating adhesion comprising, in mass %, Si: 2 to 7% and having on a surface thereof a primary coating composed mainly of forsterite, wherein the primary coating comprises a compound (A) containing one or more elements selected from among Ca, Sr and Ba, at least one rare earth metal, and sulfur.

(2) The grain-oriented electrical steel sheet excellent in coating adhesion according to (1), wherein the at least one rare earth metal is one or both of La and Ce.

(3) The grain-oriented electrical steel sheet excellent in coating adhesion according to (1) or (2), wherein the compound (A) is present at least in an interface layer between the primary coating and the steel sheet.

(4) The grain-oriented electrical steel sheet excellent in coating adhesion according to (1), wherein the grain-oriented electrical steel sheet is formed using AlN as an inhibitor.

(5) A method of producing grain-oriented electrical steel sheet excellent in coating adhesion comprising:

preparing a hot-rolled strip using a steel containing, in mass %, C: 0.10% or less, Si: 2 to 7%, Mn: 0.02 to 0.30%, one or both of S and Se: 0.001 to 0.040% in total, and a balance of Fe and unavoidable impurities;

annealing the hot-rolled strip;

finishing the annealed strip to a sheet of a final thickness by one or more cold rollings or two or more cold rollings with intermediate annealing;

decarburization annealing the cold-rolled sheet;

coating the steel sheet surface with an annealing separator; and drying and finish annealing the coated sheet, thereby producing a grain-oriented electrical steel sheet, wherein the annealing separator is one composed mainly of MgO that has a rare earth metal compound content, expressed as rare earth metal, of 0.1 to 10 mass %, an alkali earth metal compound content of one or more selected from among Ca, Sr and Ba, expressed as alkali earth metal, of 0.1 to 10 mass %, and a sulfur compound content, expressed as S, of 0.01 to 5 mass %.

(6) The method of producing grain-oriented electrical steel sheet excellent in coating adhesion according to (5), wherein the annealing separator further has a Ti compound content, expressed as Ti, of 0.5 to 10 mass %.

(7) The method of producing grain-oriented electrical steel sheet excellent in coating adhesion according to (5) or (6), wherein the steel further contains, in mass %, acid-soluble Al: 0.010 to 0.065% and N: 0.0030 to 0.0150%.

(8) The method of producing grain-oriented electrical steel sheet excellent in coating adhesion according to (5) or (6), wherein the steel further contains, in mass %, Bi: 0.0005 to 0.05%.

(9) A method of producing grain-oriented electrical steel sheet excellent in coating adhesion according to (5) or (6), wherein the steel further contains, in mass %, acid-soluble Al: 0.010 to 0.065%, N: 0.0030 to 0.0150%, and Bi: 0.0005 to 0.05%.

As set out in the foregoing, the grain-oriented electrical steel sheet according to the present invention contains, in mass %, Si: 2 to 7%, and the primary coating of the grain-oriented electrical steel sheet using AlN as inhibitor contains a compound (A) containing one or more elements selected from among Ca, Sr and Ba, at least one rare earth metal, and elemental sulfur, whereby there is obtained a grain-oriented electrical steel sheet that exhibits high coating adhesion and low coating exfoliation area rate, particular during strong bending, neither of which properties have been attainable heretofore.

Incorporation of the aforesaid compounds in the primary coating of the grain-oriented electrical steel sheet excellent in coating adhesion can be achieved by adding the rare earth metal compounds, alkali earth metal compounds, and sulfur compounds to the annealing separator composed mainly of MgO.

DETAILED DESCRIPTION OF THE INVENTION

Figure 1:
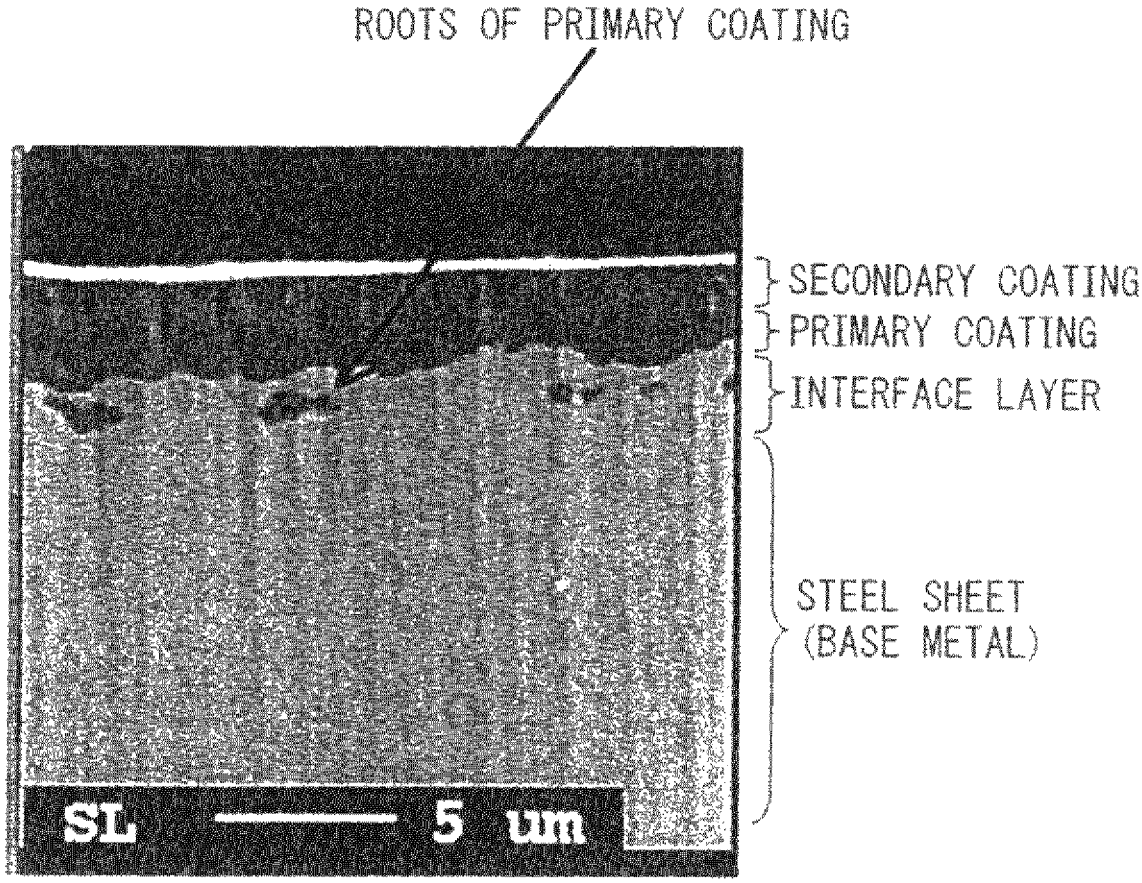
FIG. 1 is photograph showing a cross-section at the interface between a primary coating and a steel sheet.

A concrete explanation of the circumstances leading up to the invention and of the invention details follows.

The term "primary coating" when used with respect to a grain-oriented electrical steel sheet means a coating (film) composed mainly of $Mg_2SiO_4$ (forsterite) formed on the steel sheet surface by applying an annealing separator composed mainly of MgO onto a decarburization annealed steel sheet, drying it, and finish annealing the coated steel sheet to react $SiO_2$ and MgO in the decarburized oxide layer.

An insulating film for imparting insulation and/or tension composed mainly of phosphate and colloidal silica applied on top of the primary coating after finish annealing is classified as a secondary coating.

When a product sheet having a secondary coating applied on top of the primary coating is bent, peeling occurs not at the interface between the primary coating and secondary coating but at the interface between the base metal and the primary coating. Improvement of coating adhesion therefore requires improvement of adherence of the primary coating to the steel sheet.

In order to reduce the coating exfoliation area rate of the primary coating during strong bending, it is required for the coating to have excellent adherence and deformability in response to working. The primary coating composed of an oxide consisting mainly of forsterite is usually inclined to crack easily when deformed. Forming a substance having deformability in the primary coating can therefore be considered an effective way to impart good workability.

Pursuing this line of thought, the inventors discovered when the primary coating of a grain-oriented electrical steel sheet containing, in mass %, Si: 2 to 7% and using AlN as inhibitor is made to include a compound containing one or more elements selected from among Ca, Sr and Ba, at least one rare earth metal, and elemental sulfur (this compound being called "compound (A)" herein), it becomes possible to obtain a grain-oriented electrical steel sheet excellent in coating adhesion, particularly in adhesion at strongly bent regions.

Examples of the compound (A) that can be mention include sulfide composites, sulfate composites, halogenated sulfides and the like.

It is thought that the excellent adhesion at the strongly bent regions is achieved because the compound (A) in the forsterite acts effectively as a substance with deformation capacity. Particularly worth noting is that compound (A) containing sulfur has a lower Young's modulus, or is more deformable, than the structurally rigid oxide (forsterite), so that the primary coating of forsterite is imparted with workability. This effect is especially notable when the compound (A) is a sulfide composite comprising one or more alkali earth metals selected from among Ca, Sr and Ba, and at least one rare earth metal.

Unlike an ionically bonded oxide, the compound (A) approaches covalent bonding that gives rise to bonding directionality. Since much of it therefore assumes a layer structure, slip-deformation occurring between the layers is thought produce excellent deformation capacity.

As usable sulfide composites can be listed $(Ca_x, Sr_y, Ba_z)Re_2S_4$, $(Ca_x, Sr_y, Ba_z)ReS_2$, $(Ca_x, Sr_y, Ba_z)_2ReS_4$ and the like. Moreover, these may be non-stoichiometric compounds $(Ca_x, Sr_y, Ba_z)_{1-w}Re_{2+w}S_4$). The symbols x, y, z here are numbers that satisfy $x+y+z=1$, $0 \leqq x \leqq 1$, $0 \leqq y \leqq 1$, $0 \leqq z \leqq 1$, Re is a rare earth metal, and satisfies $0 \leqq w \leqq 1$.

Rare earth metals that can be contained in the compound (A) in this invention are Sc and Y belonging to group 3 of the periodic table and the lanthanoid series elements, which include La, Ce, Pr and Nd. One or more of these elements suffices. From the viewpoint of cost and availability, La and Ce are preferable. Selection of one or both of La and Ce is therefore preferable. For unknown reasons, La tends to exhibit better characteristics than Ce.

The compound (A), expressed as total of metal elements and S, is preferably present in the primary coating at the rate of 0.001 parts by mass (pbm) to 50 pbm per 100 pbm of MgO, expressed as Mg. When present at less than 0.001 pbm, the effect on adhesion is inadequate, and when present in excess of 50 pbm, the coating properties are liable to deteriorate. The more preferable range is 0.005 pbm to 30 pbm, and the still more preferable range is 0.01 pbm to 10 pbm.

The improvement of strong-bending region adhesion is optimum when the compound (A) is present in the interface layer between the primary coating and the steel sheet. The primary coating generally forms a network of roots toward the interior base metal layer. Therefore, as termed with respect to this invention, the "interface layer" between the primary coating and base metal is defined as being located at the region of transition between the layer dominated by the primary coating and the layer dominated by the base metal. As can be seen in FIG. 1, the interface layer can be observed in the coating layer cross-section.

The interface layer of this invention is determined by an analytical method such as the following.

Figure 2:
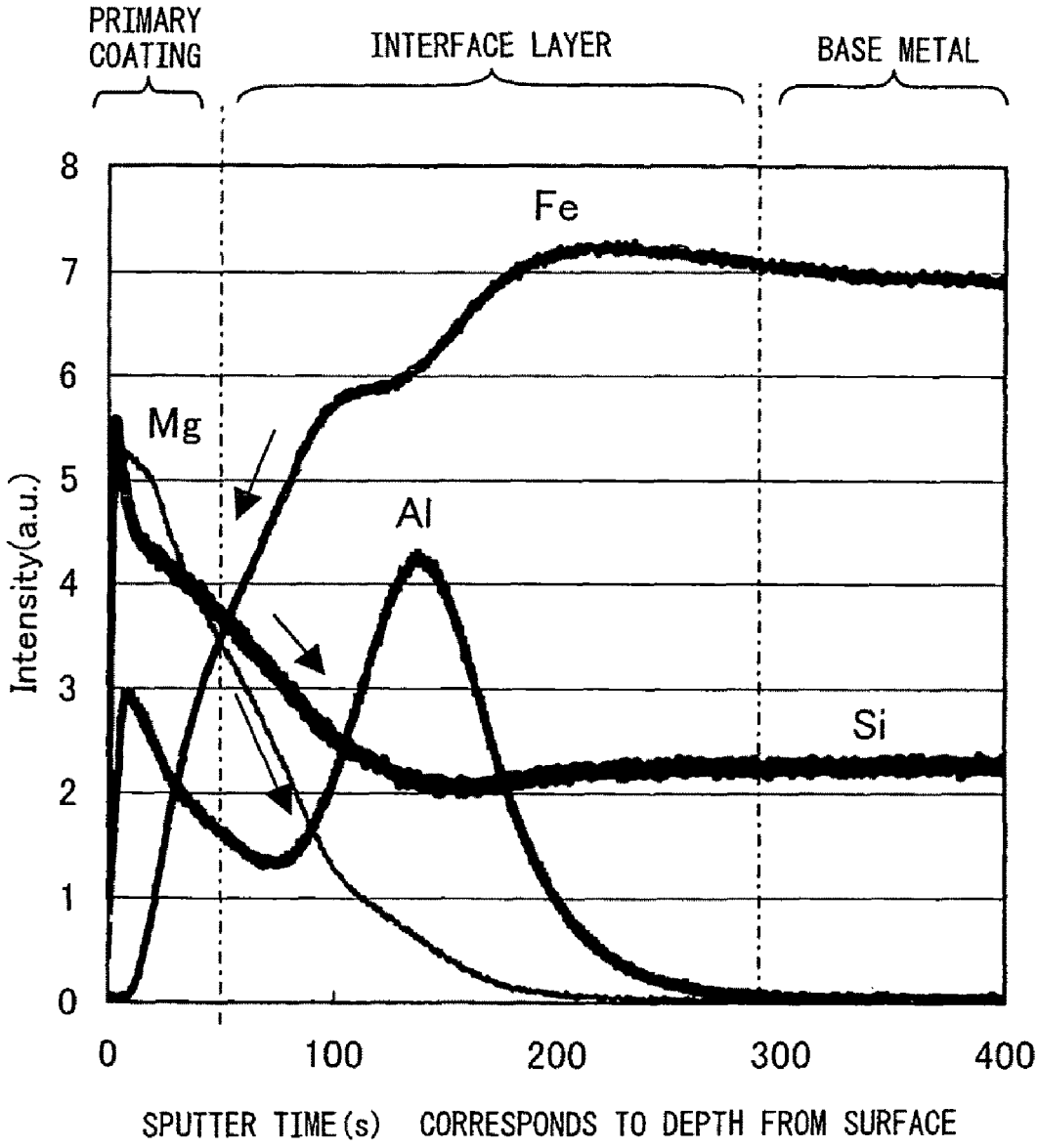
FIG. 2 is a diagram showing an example of GDS profile analysis of a primary coating.

When the distribution of elements in the depth direction is measured by a method such as glow discharge spectrometry (GDS), the peaks of Mg and Si, the main elements forming the primary coating, are found to fall with increasing depth, while the Fe peak rises with increasing depth. The numerical value where the Fe peak strength becomes constant on reaching the base metal is taken as a reference. The depth from the surface calculated from the time to when the peak was ½ this strength is defined as the starting point and the zone from there to the depth calculated from the time to when the Fe peak strength becomes constant (which depth corresponds to the depth at which Mg strength ceases to be detected) is defined as the interface layer. This is shown in FIG. 2. The interface layers in FIGS. 1 and 2 substantially match.

Presence of the compound (A) in the interface layer between the primary coating and steel sheet is desirable because it improves adhesion by strengthening the roots of the primary coating. And within the interface layer, it is particularly desirable for the compound (A) to be present from the interface layer starting point to a depth of 5 μm therefrom. When it is present at locations deeper than 5 μm, hysteresis loss may increase to degrade magnetic properties. The more preferable depth is to 3 μm.

In the particular case of a grain-oriented electrical steel sheet containing AlN as inhibitor so as to achieve high magnetic flux density, not only forsterite but also an Mg—Al oxide composite called spinel ($MgAl_2O_4$) is formed at the interface between the coating and the base metal. The spinel occurs in the primary coating and mainly in the interface layer between the primary coating and steel sheet. It is known that formation of spinel degrades adhesion. The reason is thought to be that spinel causes damage and produces exfoliation initiation points during bending. Inhibiting the damage and crack initiation point activity of spinel therefore contributes greatly to improving adhesion during bending.

When the compound (A) composed of one or more elements selected from among Ca, Sr and Ba, at least one rare earth metal, and elemental sulfur is present at the interface between the coating and steel sheet, as well as near the spinel formed inward of the steel sheet from the interface, the aforesaid damage and crack initiation point activity of the spinel is inhibited to further improve adhesion during strong bending.

When the primary coating contains Al, the compound (A), expressed as total of metal elements and S thereof, is preferably present at 0.001 pbm to 300 pbm per 100 pbm of Al. When present at less than 0.001 pbm, the effect on spinel is small, so that an adhesion improving effect may not be obtained. When present in excess of 300 pbm, the effect on spinel remains unchanged, while the coating properties are liable to deteriorate. The more preferable range is 0.01 pbm to 100 pbm.

Particularly when the compound (A) is a sulfide of one or more of Ca, Sr and Ba and at least one rare earth metal, the improvement of adhesion during strong bending is even more effective. The sulfide tends to remain in the primary coating as sulfide and tends to form at roots of the primary coating next to spinel. It is therefore thought to contribute largely to reduction of coating exfoliation area rate, especially during strong bending.

An explanation of compound (A) formation mechanism follows.

The rare earth metals accumulate abundantly at the surface layer of the primary coating because their diffusion rate in the decarburized oxide layer is slow. Sulfides of the rare earth metal therefore readily occur near the coating surface. On the other hand, Ca, Sr and Ba, which diffuse rapidly in the decarburized oxide layer, reach the roots of the decarburized oxide layer at an inner layer of the base metal during finish annealing, at 1,000° C. or less. When the steel contains Al, the Al diffuses from the steel interior to the surface layer where, provided that Mg is not present, it forms oxide composites with Ca, Sr or Ba. and remains at the location of the decarburized oxide layer roots.

As pointed out earlier, an annealing separator composed mainly of MgO is used. Therefore, when the steel contains Al, Al diffusing from the interior to the surface of the steel reacts with Mg diffused in the steel surface layer during high temperature treatment, thereby forming spinel. When one or more of Ca, Sr and Ba are co-present, a portion thereof is captured by spinel but most diffuses to the surface layer to form sulfides. In other words, Mg reacts preferably, not with Ca, Sr and Ba, but with Al, thereby forming spinel oxide at the interface between the coating and steel sheet.

As mentioned above, rare earth metals readily form sulfides in the surface region of the coating. However, when one or more of Ca, Sr and B are co-present, the rare earth metal(s) diffuse to the interior, so that stable oxide composites of rare earth metal(s) and Ca, Sr and/or Ba form, with the Ca, Sr and/or Ba remaining at the roots of the decarburized oxide layer. Further, since the sulfide composite is formed where Al is present, it finally comes to be present in the proximity of spinel. The considerable effect toward adhesion improvement is therefore presumed to be attributable to the fact that deformable sulfides are present where they can directly mitigate the adverse effect of the spinel as crack initiation points.

As set out in the foregoing, the formed sulfides of rare earth metal(s), Ca, Sr and/or Ba tend to remain in the primary coating as sulfides and, moreover, tend to form at the roots of the primary coating next to the spinel, so that they can contribute greatly to reduction of coating exfoliation area rate particularly during strong bending.

In this invention, adhesion at the strongly bent region is determined by wrapping the steel sheet around a round bar of 10 mm or smaller diameter and is expressed as the coating exfoliation area rate defined as the ratio of the area where coating exfoliation occurred to the worked area of the steel sheet in contact with the round bar. Specifically, test pieces are prepared by applying insulating film coatings over their primary coatings, the test pieces are wrapped around round bars of different diameter, and the coating exfoliation area rates of the test pieces at the different round bar diameters are evaluated.

The coating exfoliation area rate is the ratio obtained by dividing the actually peeled area by the worked area (area of the test piece in contact with the round bar; equal to text piece width×round bar diameter×π). Even if peeling occurs during strong bending, degradation of transformer characteristics can be minimized if the peeling does not progress so that the exfoliation area rate is low.

As the method for incorporating the compound (A) into the primary coating, and the method for controlling the same, it is effective to introduce the additional components into the annealing separator. As steel sheet used in a wound core is required to have excellent magnetic properties, it is more effect to utilize the steel sheet using AlN and MnS as inhibitor taught by Japanese Patent Publication (B) No. S40-15644 and further using Bi as auxiliary inhibitor, as taught by Japanese Patent Publication (A) No. H6-88171.

The production method of the present invention is explained in detail in the following.

As the steel there can be used one comprising, in mass %, C: 0.10% or less, Si: 2 to 7%, Mn: 0.02 to 0.30%, one or both of S and Se: 0.001 to 0.040% in total, and a balance of Fe and unavoidable impurities. It is also possible to use a steel of the foregoing composition further comprising acid-soluble Al: 0.010 to 0.065%, N: 0.0030 to 0.0150%, a steel of the foregoing composition further comprising Bi: 0.0005 to 0.05%, or a steel of the foregoing composition further comprising acid-soluble Al: 0.010 to 0.065%, N: 0.0030 to 0.0150%, and Bi: 0.0005 to 0.05%.

Si is an element extremely effective for increasing the electrical resistance of the steel and reducing the eddy current loss component of the core loss. However, eddy current loss cannot be minimized when the Si content is less than 2%. And a content in excess of 7.0% is undesirable because the workability of the steel is markedly degraded.

C of a content exceeding 0.10% is undesirable because the time required for decarburization during decarburization annealing following cold rolling becomes long, which is uneconomical, and also because the decarburization tends to be incomplete, so that the product sustains a magnetic property defect known as magnetic aging.

Mn is an important element that forms MnS and/or MnSe, which are known as inhibitors that control secondary recrystallization. An Mn content of less than 0.02% is undesirable because at this level the amount of MnS and/or MnSe formed is below the absolute amount required for giving rise to secondary recrystallization. When the content exceeds 0.3%, solid dissolution during slab heating is hard to achieve and, in addition, the precipitation size during hot rolling tends to become coarse, so that the optimum size distribution as an inhibitor cannot be realized.

S and/or Se are important elements that combine with Mn to form the MnS and/or MnSe mentioned above. At a content outside the above range, an adequate inhibitor effect cannot be obtained. The total content of one or both of S and Se must therefore be defined as 0.001 to 0.040% in total.

Acid soluble Al is effective as an element constituting the main inhibitor of a high magnetic flux density grain-oriented electrical steel sheet. A content in the range of 0.010 to 0.65% is preferable. A content of less than 0.010% may in some case be undesirable because it may result in inadequate inhibitor strength owing to deficient quantity being available. On the other hand, a content exceeding 0.065% may be undesirable because at this level, the AlN precipitated as inhibitor is liable to coarsen, thereby lowering the inhibitor strength.

N is an important element that combines with the acid-soluble Al to form AlN. At a content outside the above range, an adequate inhibitor effect may not be obtained. The content of N is therefore preferably defined as 0.0030 to 0.0150%.

Bi is an extremely useful element for use as an auxiliary inhibitor enabling stable production of grain-oriented electrical steel sheet with ultra-high magnetic flux density. Bi does not thoroughly exhibit its effect at a content of less than 0.0005%. When present in excess of 0.05%, the magnetic flux density improving effect saturates and cracks are liable to occur at the ends of the hot-rolled coil.

In addition, as elements for stabilizing the secondary recrystallization, it is effective also to include one or more of Sn, Cu, Sb, As, Mo, Cr, P, Ni, B, Te, Pb, V, and Ge in an amount of 0.003 to 0.5%. When the amount of these elements added is less than 0.003%, the effect of stabilizing secondary recrystallization is insufficient, while when it is greater than 0.5%, the effect saturates, so the upper limit of addition is preferably defined as 0.5% from the viewpoint of cost.

The molten steel for producing the grain-oriented electrical steel sheet that has been adjusted to the chemical composition set out in the foregoing is cast using an ordinary method. The casting method is not particularly limited. Next, the slab is hot-rolled by an ordinary method to obtain a hot-rolled coil. Usually, in order to put the MnS and AlN inhibitor components sufficiently into solid solution, the slab is heated at a high temperature above 1300° C. However, where priority is to be placed on productivity and economy, the slab heating can be conducted at a temperature of about 1250° C., provided that inhibitor strengthening is performed in a downstream process, in the steel strip state, using nitriding from the exterior. This processing does not deviate from the principle of the present invention.

The foregoing processing provides a grain-oriented electrical steel strip.

The grain-oriented electrical steel strip is then annealed and thereafter finished to the product thickness by a single finish cold rolling pass, multiple cold rolling passes, or multiple cold rolling passes with intermediate annealing. In the annealing prior to the finish cold rolling, the crystal structure is homogenized and the precipitation of AlN is controlled.

The strip rolled to a final product thickness as mentioned above is subjected to decarburization annealing. The decarburization annealing is performed in the usual manner using heat treatment in wet hydrogen to reduce the C in the steel sheet down to the region where magnetic aging deterioration of the product sheet will not occur and simultaneously to subject the cold rolled strip to primary recrystallization in preparation for secondary recrystallization. Before this decarburization annealing, it is preferable in a preceding stage to perform recrystallization and core loss property improvement by, as taught by Japanese Patent Publication (A) No. H8-295937 and Japanese Patent Publication (A) No. H9-118921, performing heating at the rate of 80° C./s or greater.

Further, final finish annealing is applied at 1,100° C. or higher for the purpose of primary film formation, secondary recrystallization and purification. This finish annealing is applied to the strip in the state of a coil. An annealing separator powder composed mainly of MgO is applied to the surface of the steel strip for the purpose of seizure prevention and primary coating formation. The annealing separator powder is generally applied to and dried on the steel strip surface in the form of an aqueous slurry, but the electrostatic coating method may be used instead.

When the annealing separator is applied in the form of a slurry, it is preferable for the slurry not to contain chlorine ions or, if it does, for the chlorine ions to be contained at not greater than 500 mg/L. When the chlorine ion content exceeds 500 mg/L, good results may not be obtained owing to uneven annealing separator application. In one embodiment of the invention, the annealing separator has a rare earth metal compound content, expressed as rare earth metal, of 0.1 to 10 mass %, an alkali earth metal compound content of one or of Ca, Sr and Ba, expressed as alkali earth metal, of 0.1 to 10 mass %, and a sulfur compound content, expressed as S, of 0.01 to 5 mass %. The mass percentages given here are based on the mass percentage of the annealing separator including the aforesaid compounds as 100 mass %. The method of this embodiment provides a grain-oriented electrical steel sheet having a small exfoliation area rate during strong bending.

When amount of rare earth metal compound added and the amount of alkali earth metal compound added are less than 0.1 mass %, respectively, adequate formation of the compound composite is hard to achieve, so that exfoliation area rate becomes large. On the other hand, when they exceed 10 mass %, respectively, the application performance of the MgO slurry is poor. This is undesirable because it raises issues regarding coating uniformity and properties. The amount of rare earth metal compound addition, expressed as rare earth metal, is more preferably 0.2 to 10 mass %, still more preferably 0.2 to 5 mass %, and most preferably 0.5 to 3 mass %.

The rare earth metal compounds can be added as any type of compound, examples including oxides, sulfides, sulfates, silicides, phosphates, hydroxides, carbonates, borides, chlorides, fluorides and bromides. The compounds can be used in any form or combination. From the viewpoint of availability and cost, La and Ce compounds are preferably used as the rare earth metal compounds.

Taking the magnetic properties into account, the amount of the alkali earth metal compounds of Ca, Sr and Ba, expressed as alkali earth metal, is preferably 0.5 to 10 mass %, more preferably 1 to 5 mass %.

Ca, Sr and Ba can be added as any type of compound, examples including oxides, sulfides, sulfates, silicides, phosphates, hydroxides, carbonates, borides, chlorides, fluorides and bromides. The compounds can be used in any form or combination.

When the amount of sulfur compound addition, expressed as S, is less than 0.01 mass %, it becomes difficult to suppress the effect on secondary recrystallization. When it is greater than 5 mass percent, purification is adversely affected. The range is more preferably 0.05 to 3 mass %, still more preferably 0.1 to 1 mass %.

The added sulfur compounds can be of any kind. For example, it is possible to add sulfides or sulfates of any of various metals. The method of adding the sulfur compound by adding sulfuric acid to the annealing separator slurry can also be adopted. Further, the simultaneously added rare earth metal compounds and alkali earth metal compounds can be supplied as sulfides or sulfates. This is advantageous because it minimizes the number of added components and enhances the reaction rate of sulfide composite formation. When the simultaneously added rare earth metal compounds and alkali earth metal compounds can be supplied as sulfides or sulfates, the added amount of the sulfur compounds, including the sulfur contained in the aforesaid compounds, is calculated as S equivalent.

When S is present in the steel, it is supplied to the steel surface layer by diffusion during finish annealing, so that sulfides are formed even if S is not added to the annealing separator. However, when formation of sulfides by S in the steel is promoted by rare earth metals and alkali earth metals added to the annealing separator, the resulting consumption of S in the steel may change the secondary recrystallization behavior in a way that affects the magnetic properties. The method of adding S to the annealing separator in advance is therefore preferable.

In addition, adding Ti compounds to the annealing separator in an amount expressed as Ti of 0.5 to 10 mass % further improves coating adhesion. When the added amount expressed as Ti is less than 0.5 mass %, there is liable to be no effect of reducing the coating exfoliation rate. When it is greater than 10 mass %, the core loss property of the product sheet is liable to decline. The amount of Ti compound addition is preferably within the foregoing range. Usable Ti compounds include, for example, $TiO_2$, $Ti_3O_5$, $Ti_2O_3$, TiO, TiC, TiN, $TiB_2$, and $TiSi_2$. All such compounds work to improve coating exfoliation property. The added amount of the Ti compounds expressed as Ti is preferably 1 to 8 mass %, more preferably 2 to 6 mass %.

In the final annealing, it is preferable to dewater the MgO by including a dewatering step ahead of the secondary recrystallization annealing in which the sheet is held at a low temperature of 700° C. or less in a reducing atmosphere of 20% or greater $H_2$ concentration.

In most cases, an insulating coating is further formed on the primary coating after finish annealing. An insulating coating obtained by applying and baking a coating solution composed chiefly of a phosphate and colloidal silica onto the steel sheet surface is particularly advantageous because the large tension it imparts to the steel sheet further improves the core loss property.

It also preferable, as required, to subject the surface of the grain-oriented electrical steel sheet to magnetic domain refinement by, for example, laser irradiation, plasma irradiation, grooving with a toothed roll or by etching.

By the foregoing procedures there is obtained an excellent grain-oriented electrical steel sheet having a primary coating composed mainly of forsterite.

When the so-obtained grain-oriented electrical steel sheet is used to fabricate a transformer, specifically when it is used to fabricate a large wound core transformer, the laminations sheared from the sheet are stacked, rounded, and the reformed with a die. At this time, particularly the inner periphery of the core is subjected to working at a very small radius of curvature. This is markedly strong working in comparison with that of the bending adhesion test conducted at several tens of millimeter diameter bending that is generally used to evaluate coating adhesion. In order prevent coating exfoliation adequately even under such working, the coating exfoliation area rate in a 5 mm diameter strong bending adhesion test is preferably 20% or less, more preferably 10% or less, most preferably 5% or less.

Now follows an explanation of the method of analyzing the compound (A) containing at least one rare earth metal, one or more of Ca, Sr and Ba, and sulfur.

The analysis can be performed by a method such as glow discharge spectrometry (GDS) in which plasma etching is conducted from the surface and the light emitted when the progressively etched elements are excited by the plasma is detected. Use of this method provides a depth-direction profile of the coating components and makes it possible to determine from the different intensities of the light emitted by the rare earth metals, alkali earth metals, and sulfur whether the elements are present at the same depth.

Whether or not elements are present at the same location can also be ascertained more directly by polishing a cross-section of the steel sheet and then using Auger electron spectrometry (AES) or field emission electron probe micro-analysis (FE-EPMA) to map the locations of the rare earth metals, alkali earth metals and sulfur.

Another method of measurement is to extract and analyze only the coating region. As a method for reliably extracting and separating the coating region, the non-aqueous solvent controlled potential electrolysis method (SPEED method) is well known as a method characterized by its ability to reliably extract even unstable compounds. As the electrolyte is generally used a mixed solution of 10 vol % acetylacetone—1 mass % tetramethylammonium chloride (TMAC), a mixed solution of 10 vol % anhydrous maleic acid—1 mass % TMAC—methanol, or a mixed solution of 10 vol % methyl salicylate—1 mass % TMAC—methanol.

A specific example of an extraction method will be explained.

First a test specimen taken from the steel sheet is processed to the size of 20 mm×30 mm×sheet thickness, whereafter it is cleaned by preliminary electrolysis. The size of the test piece need not necessarily be that mentioned here. However, in view of the practical limit on the size of the electrolysis tank and electrodes, the test piece is preferably fabricated to a size no larger than about 50 mm per side.

Next, the region of the test piece from the coating to the base metal interface is dissolved by the SPEED method. An ordinary electrolyte can be used. Typical of these are a mixed solution of 10 vol % acetylacetone—1 mass % tetramethylammonium chloride (TMAC)—methanol, a mixed solution of 10 vol % anhydrous maleic acid—1 mass % TMAC—methanol, a mixed solution of 10 vol % methyl salicylate—1 mass % TMAC—methanol, and a mixed solution of 2 vol % triethanolamine—1 mass % TMAC—methanol.

Particularly in the case of extracting sulfides from the coating, a mixed solution of 10 vol % methyl salicylate—1 mass % TMAC—methanol is preferable because it enables relatively consistent extraction.

Taking into account that 96,000 coulombs of electricity electrolyzes the equivalent of 1 mole, electrolysis is preferably conducted with the quantity of electricity controlled to the number of coulombs capable of electrolyzing approximately 10 to 20 μm of surface layer over the surface area of the test piece.

Upon completion of the electrolysis, the test piece is transferred to a beaker containing a methanol solution and ultrasonic-impact treated for several seconds to completely peel the surface layer from the test piece. Next, the electrolyte and aforesaid ultrasonically treated methanol solution are recovered by suction filtration using a filter (e.g., a 0.2 μm membrane filter). The presence of metals and sulfur in the coating components obtained in this manner can be ascertained with an x-ray fluorescence spectrometer and the crystal structure can be analyzed using an X-ray diffractometer.

Examples

First Set of Examples

A silicon steel slab containing C: 0.06 mass %, Si: 3.3 mass %, Mn: 0.08 mass %, S: 0.02 mass %, Al: 0.027 mass % and N: 0.0082 mass %, and containing as auxiliary inhibitor Bi: 0.03 mass %, the balance being Fe and unavoidable impurities, was post-hot-roll annealed, cold rolled to a thickness of 0.23 mm, and decarburization annealed. The surface of the so-obtained steel sheet was coated with an aqueous slurry prepared using an annealing separator obtained by adding to an MgO annealing separator rare earth metal compound and alkali earth metal compound in one of the combinations of components and ratios shown in Table 1, and the applied aqueous slurry was dried. The chlorine ion content of the aqueous slurry was controlled to the range of 50 to 80 mg/L. Sulfur compound was simultaneously added as rare earth metal compound and/or alkali earth metal compound. The coated steel sheet was finish annealed by holding for 20 hours in dry hydrogen at up to a peak temperature of 1,180° C.

The results of adhesion evaluation are shown in Table 2. The adhesion evaluation was conducted on test pieces each further provided with an insulating film coating on the primary coating obtained after finish annealing, by wrapping the test piece around one of different diameter round bars. The so-determined coating exfoliation area rates are shown for the respective round bar diameters. The coating exfoliation area rate referred to here is the ratio obtained by dividing the actually peeled area by the worked area (area of the test piece in contact with the round bar; equal to the text piece width× round bar diameter×π). Even if peeling occurs during strong bending, degradation of transformer characteristics can be minimized if the peeling does not progress so that the exfoliation area rate is low. The exfoliation area rate was evaluated in seven grades, A for 0%, B for greater than 0% and less than 20%, C for greater than 20% and less than 40%, D for greater than 40% and less than 60%, E for greater than 60% and less than 80%, F for 80% and less than 100%, and G for 100%. A rating of B or better was considered to mean that the effect was good.

As can be seen from Tables 1 and 2, improved coating exfoliation area rate was observed when at least one rare earth metal compound and one or more of Ca, Sr and Ba were added to the annealing separator. It was ascertained that compounds containing rare earth metal, alkali earth metal of Ca, Sr and/or Ba, and sulfur, namely sulfide composites of rare earth metal and alkali earth metal, were formed in the primary coatings of the steel sheets that achieved good coating exfoliation rates.

TABLE 1

| No. | Rare earth metal compound | Content expressed as rare earth metal (Mass %) | Alkali earth metal compound | Content expressed as alkali earth metal (Mass %) | Content expressed as S (Mass %) | Remark |
|---|---|---|---|---|---|---|
| 1-1 | None | 0 | None | 0 | 0 | Comparative Example |
| 1-2 | None | 0 | $Sr(OH)_2$ | 1 | 0 | Comparative Example |
| 1-3 | None | 0 | $CaSO_4$ | 1 | 0.8 | Comparative Example |
| 1-4 | $La_2O_3$ | 1 | None | 0 | 0 | Comparative Example |
| 1-5 | $La_2O_3$ | 1 | $BaSO_4$ | 1 | 0.23 | Invention Example |
| 1-6 | $CeO_2$ | 1 | $Ca(OH)_2$ | 1 | 0 | Invention Example |
| 1-7 | $Ce(SO_4)_2$ | 1 | None | 0 | 0.46 | Comparative Example |
| 1-8 | $Ce_2(SO_4)_2$ | 1 | $Sr(OH)_2$ | 1 | 0.23 | Invention Example |

TABLE 2

| No. | 20 mmϕ exfoliation area rate | 10 mmϕ exfoliation area rate | 5 mmϕ exfoliation area rate | B8 (T) | W17/50 (W/kg) | Sulfide composite formation? | Remark |
|---|---|---|---|---|---|---|---|
| 1-1 | G | G | G | 1.96 | 0.82 | No | Comparative Example |
| 1-2 | C | D | F | 1.94 | 0.81 | No | Comparative Example |
| 1-3 | C | D | F | 1.93 | 0.82 | No | Comparative Example |
| 1-4 | A | B | C | 1.90 | 0.85 | No | Comparative Example |
| 1-5 | A | A | B | 1.94 | 0.83 | Yes | Invention Example |
| 1-6 | A | A | B | 1.89 | 0.87 | Yes | Invention Example |
| 1-7 | A | C | D | 1.94 | 0.82 | No | Comparative Example |
| 1-8 | A | A | B | 1.95 | 0.81 | No | Invention Example |

Figure 3:
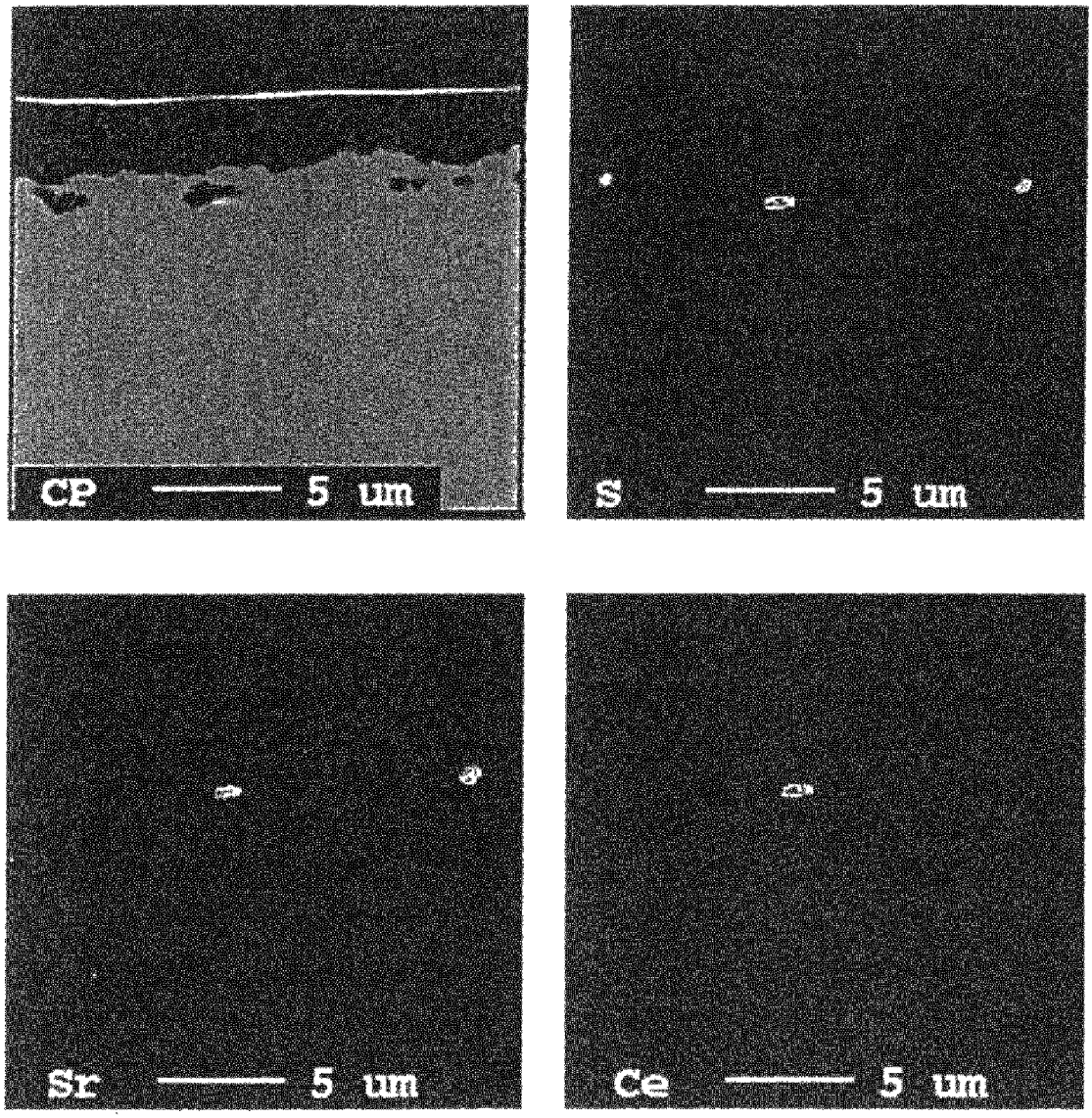
FIG. 3 is a set of FE-EMPA images showing a cross-section of the coating of a specimen of small coating exfoliation area rate during strong bending (upper left), S mapping (upper right), Sr mapping (lower left), and Ce mapping (lower right).

FIG. 3 is a set of FE-EMPA images showing a cross-section of the coating of Invention Example 1-8 of the First Set of Examples, including an S mapping photo, and Sr mapping photo, and a Ce mapping photo. A compound in which the rare earth metal Ce, the alkali earth metal Sr, and S are co-present can be seen. After extraction, the compound was examined by X-ray diffraction and found to be the sulfide composite $SrCe_2S_4$, thus confirming the presence of sulfide composite. Similarly, it was also found that sulfides were formed in the primary coatings of the other invention examples. In contrast, no such sulfides were formed in the Comparative Examples 1-1 to 1-4 and 1-7.

Figure 4:
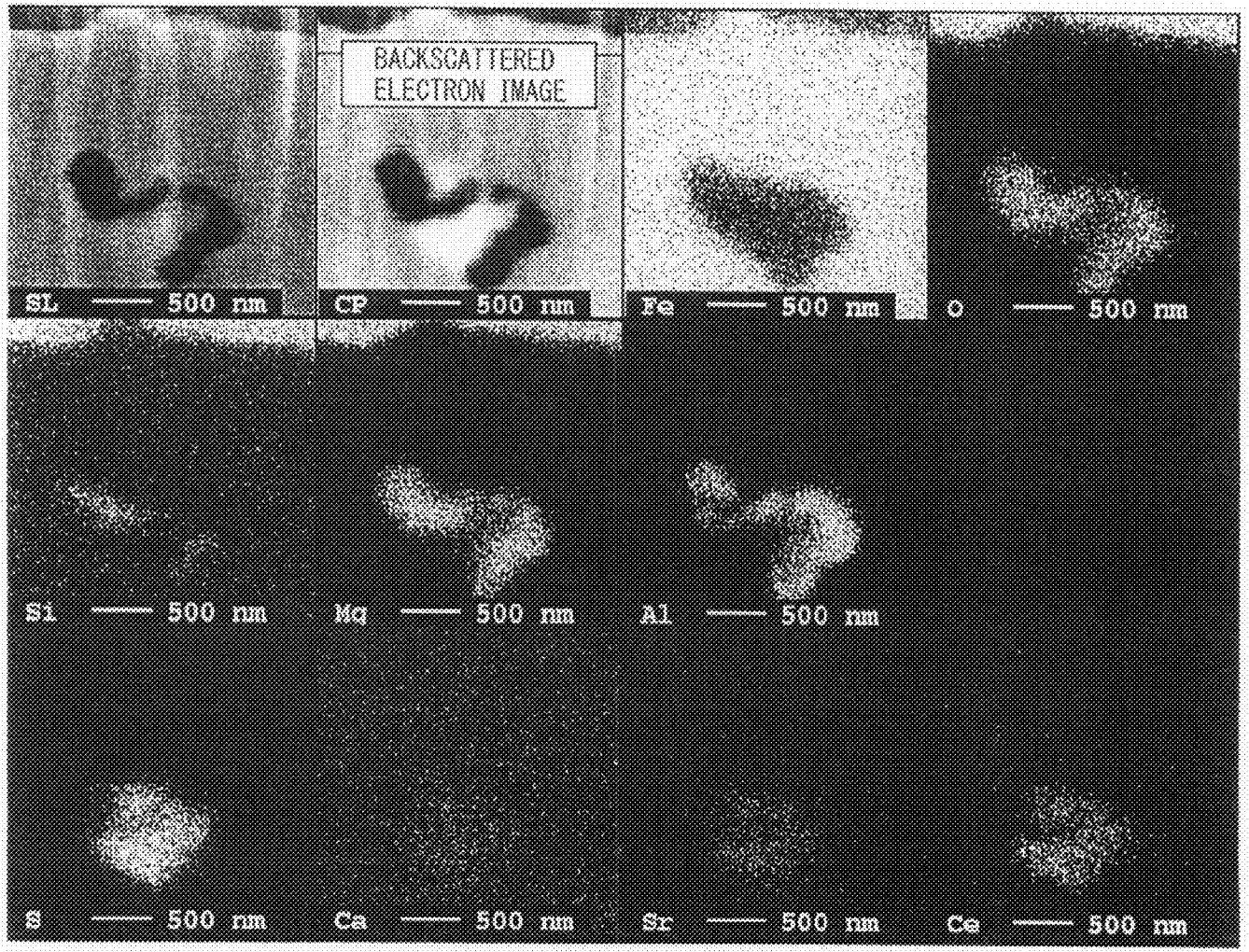
FIG. 4 is an FE-EMPA image of Sr, Ce and S compound (in the backscattered electron image, SrCeS compound of white appearance is present next to spinel ($MgAl_2O_4$) of black appearance).

FIG. 4 is an FE-EMPA image showing $SrCe_2S_4$ located next to spinel in the same Invention Example 1-8 of the First Set of Examples as shown in FIG. 3.

Similarly, it was also found that sulfides of rare earth metal and one or more of Ca, Sr and Ba were formed at the roots of the primary coating next to spinel in the other invention examples. In these materials, the reduction of coating exfoliation area rate during strong bending was particularly notable.

Second Set of Examples

A silicon steel slab containing, in mass %, C: 0.08%, Si: 3.2%, Mn: 0.075%, S: 0.024%, acid-soluble Al: 0.024%, N: 0.008%, Sn: 0.1%, Cu; 0.1%, Bi: 0.005%, and the balance of Fe and unavoidable impurities was heated at 1,350° C., and hot rolled to a thickness of 2.3 mm, whereafter the hot-rolled strip was annealed for 1 min at 1,120° C. The annealed strip was then cold rolled to the final thickness of 0.23 mm. The temperature of the so-obtained sheet was elevated to 850° C. by electric resistance heating at the rate of 300° C./s and then decarburization annealed for 2 min in wet hydrogen at 830° C. The surface of the sheet was then coated with an aqueous slurry prepared by adding additives shown in Table 3 to an MgO annealing separator containing 5 mass % $TiO_2$. The coated steel sheet was high-temperature annealed for 20 hr in a wet hydrogen atmosphere at up to a peak temperature of 1,200° C. The chlorine ion content of the aqueous slurry was controlled to the range of 10 to 30 mg/L. The high-temperature annealed sheet was washed, coated with an insulating film composed mainly of aluminum phosphate and colloidal silica, baked, grooved at a constant pitch using a toothed roll, and stress-relief annealed.

The properties and exfoliation area rates of the obtained product sheets are shown in Table 4. The coils satisfying the invention conditions were grain-oriented electrical steel sheets excellent in coating adhesion, particularly coating exfoliation area rate during strong working, and in magnetic properties.

TABLE 3

| No. | Rare earth metal compound | Content expressed as rare earth metal (Mass %) | Alkali earth metal compound | Content expressed as alkali earth metal (Mass %) | Sulfur-containing compound | Content expressed as S (Mass %) | Remark |
|---|---|---|---|---|---|---|---|
| 2-1 | | 0 | None | 0 | None | 0 | Comparative Example |
| 2-2 | None | 0 | None | 0 | $MgSO_4$ | 2 | Comparative Example |
| 2-3 | None | 0 | $Ca(OH)_2$ | 1 | MgS | 1 | Comparative Example |
| 2-4 | $CeO_2$ | 2 | $SrSO_4$ | 2 | $(SrSO_4)$ | 0.74 | Invention Example |
| 2-5 | $CeO_2$<br>$La_2O_3$ | 2<br>3 | $Ba(OH)_2$ | 2 | $FeSO_4$ | 0.5 | Invention Example |
| 2-6 | $La_2O_3$ | 5 | $BaSO_4$ | 5 | $MgSO_4$ | 3 | Invention Example |
| 2-7 | $Ce(SO_4)_2$ | 3 | $Ca(OH)_2$ | 2 | $(Ce(SO_4)_2)$<br>$MgSO_4$ | 1.4<br>2.6 | Invention Example |
| 2-8 | $La_2(SO_4)_3$ | 2 | $SrSO_4$ | 1 | $(La2(SO_4)_3)$<br>$(SrSO_4)$ | 1.4<br>0.37 | Invention Example |
| 2-9 | $Ce(SO_4)_2$ | 3 | $Ca(OH)_2$<br>$Ba(OH)_2$ | 2 | $(Ce(SO_4)_2)$<br>$MgSO_4$ | 1.4<br>2.6 | Invention Example |
| 2-10 | $Y_2(SO_4)_3$ | 2 | $SrSO_4$ | 1 | $Y_2(SO_4)_3$<br>$(SrSO_4)$ | 1.08<br>0.37 | Invention Example |

Note:
Sulfur compounds in parentheses were added simultaneously as rare earth metal compounds or alkali earth metal compounds.

TABLE 4

| No. | 20 mmϕ exfoliation area rate | 10 mmϕ exfoliation area rate | 5 mmϕ exfoliation area rate | B8 (T) | W17/50 (W/kg) | Sulfide composite formation? | Remark |
|---|---|---|---|---|---|---|---|
| 2-1 | G | G | G | 1.95 | 0.70 | No | Comparative Example |
| 2-2 | G | G | G | 1.94 | 0.71 | No | Comparative Example |
| 2-3 | E | G | G | 1.95 | 0.70 | No | Comparative Example |
| 2-4 | A | B | B | 1.94 | 0.71 | Yes | Invention Example |
| 2-5 | A | A | B | 1.95 | 0.70 | Yes | Invention Example |

TABLE 4-continued

| No. | 20 mmφ exfoliation area rate | 10 mmφ exfoliation area rate | 5 mmφ exfoliation area rate | B8 (T) | W17/50 (W/kg) | Sulfide composite formation? | Remark |
|---|---|---|---|---|---|---|---|
| 2-6 | A | A | B | 1.95 | 0.71 | Yes | Invention Example |
| 2-7 | A | B | B | 1.96 | 0.68 | Yes | Invention Example |
| 2-8 | A | A | B | 1.96 | 0.69 | Yes | Invention Example |
| 2-9 | A | A | B | 1.96 | 0.69 | Yes | Invention Example |
| 2-10 | A | B | B | 1.95 | 0.70 | Yes | Invention Example |

Third Set of Examples

A steel slab containing, in mass %, C: 0.08%, Si: 3.2%, Mn: 0.075%, S: 0.024%, acid-soluble Al: 0.023%, N: 0.008%, Sn: 0.1%, and the balance of Fe and unavoidable impurities was heated at 1,340° C. and hot rolled to a thickness of 2.3 mm, whereafter the hot-rolled strip was annealed for 1 min at 1,110° C. The annealed strip was then cold rolled to the final thickness of 0.23 mm. The temperature of the so-obtained sheet was elevated to 850° C. by electric resistance heating at the rate of 300° C./s and then decarburization annealed for 2 min in wet hydrogen at 830° C. The surface of the sheet was then coated with an aqueous slurry prepared by adding additives shown in Table 5 to an annealing separator. The coated steel sheet was high-temperature annealed for 15 hr in a hydrogen gas atmosphere at up to a peak temperature of 1,180° C. The chlorine ion content of the aqueous slurry was controlled to the range of 40 to 60 mg/L. The high-temperature annealed sheet was washed, coated with an insulating film composed mainly of magnesium phosphate and colloidal silica, baked, and scanned with a laser beam for magnetic domain refinement. The properties of the obtained product sheets are shown in Table 6.

The coils that satisfied the invention conditions were grain-oriented electrical steel sheets having small coating exfoliation area rates during strong bending and were excellent in coating adhesion.

TABLE 5

| No. | Rare earth metal compound | Content expressed as rare earth metal (Mass %) | Alkali earth metal compound | Content expressed as alkali earth metal (Mass %) | Sulfur-containing compound | Content expressed as S (Mass %) | Ti compound | Content expressed as Ti (Mass %) | Remark |
|---|---|---|---|---|---|---|---|---|---|
| 3-1 | None | 0 | None | 0 | None | 0 | None | 0 | Comparative Example |
| 3-2 | None | 0 | None | 0 | $Li_2SO_4$ | 2 | $TiO_2$ | 2 | Comparative Example |
| 3-3 | $CeO_2$ | 0.005 | $Ca(OH)_2$ | 12 | MgS | 8 | $Ti_2O_3$ | 3 | Comparative Example |
| 3-4 | $Nd_2O_3$ | 3 | $Sr(OH)_2$ | 8 | $MnSO_4$<br>$TiSO_4$ | 0.1<br>0.67 | $TiSO_4$ | 1 | Invention Example |
| 3-5 | $La(OH)_3$ | 2 | $Ba(OH)_2$ | 0.1 | $FeSO_4$<br>$Li_2SO_4$ | 0.5<br>0.1 | $TiO_2$ | 5 | Invention Example |
| 3-6 | $Ce(OH)_4$ | 3 | $Ca(OH)_2$<br>$SrSO_4$ | 0.3<br>3 | ($SrSO_4$)<br>$H_2SO_4$ | 0.56<br>0.2 | $TiO_2$ | 4 | Invention Example |
| 3-7 | $Y_2O_3$ | 3 | $CaSO_4$<br>$BaSO_4$ | 4<br>6 | ($CaSO_4$)<br>($BaSO_4$) | 0.32<br>1.4 | $Ti_2O_3$ | 3 | Invention Example |
| 3-8 | $La_2O_3$ | 2 | $Sr(OH)_4$ | 5 | $MgSO_4$ | 2 | None | 0 | Invention Example |
| 3-9 | $Pr_6O_{11}$ | 2 | $BaSO_4$ | 1 | ($BaSO_4$) | 1.4 | $TiO_2$ | 2 | Invention Example |

Note:

Sulfur compounds in parentheses were added simultaneously as rare earth metal compounds or alkali earth metal compounds.

| No. | 20 mmφ exfoliation area rate | 10 mmφ exfoliation area rate | 5 mmφ exfoliation area rate | B8 (T) | W17/50 (W/kg) | Sulfide composite formation? | Sulfide location | Remark |
|---|---|---|---|---|---|---|---|---|
| 3-1 | D | E | G | 1.90 | 0.76 | No | — | Comparative Example |
| 3-2 | A | D | F | 1.92 | 0.74 | No | — | Comparative Example |

-continued

| No. | 20 mmϕ exfoliation area rate | 10 mmϕ exfoliation area rate | 5 mmϕ exfoliation area rate | B8 (T) | W17/50 (W/kg) | Sulfide composite formation? | Sulfide location | Remark |
|---|---|---|---|---|---|---|---|---|
| 3-3 | A | A | D | 1.91 | 0.75 | No | — | Comparative Example |
| 3-4 | A | A | A | 1.93 | 0.74 | Yes | Primary coating + Interface layer | Invention Example |
| 3-5 | A | A | B | 1.93 | 0.73 | Yes | Primary coating | Invention Example |
| 3-6 | A | A | A | 1.92 | 0.74 | Yes | Primary coating | Invention example |
| 3-7 | A | A | A | 1.91 | 0.76 | Yes | Primary coating + Interface layer | Invention Example |
| 3-8 | A | A | B | 1.92 | 0.74 | Yes | Interface layer | Invention Example |
| 3-9 | A | B | B | 1.92 | 0.73 | Yes | Primary coating | Invention Example |

Fourth Set of Examples

A steel slab containing, in mass %, C: 0.044%, Si: 3.2%, Mn: 0.083%, S: 0.027%, and the balance of Fe was heated at 1,300° C., hot rolled to a thickness of 2.3 mm, and cold rolled 0.83 mm, whereafter the cold-rolled sheet was intermediate-annealed for 1 min at 900° C. and then cold rolled to a thickness of 0.29 mm. The cold-rolled sheet was decarburization annealed for 2 min in wet hydrogen at 840° C. The surface of the sheet was the coated with an aqueous slurry prepared by adding additives shown in Table 7 to an MgO annealing separator. The coated steel sheet was high-temperature annealed for 20 hr in a hydrogen gas atmosphere at up to a peak temperature of 1,200° C. The chlorine ion content of the aqueous slurry was controlled to the range of 30 to 50 mg/L. The high-temperature annealed sheet was washed, coated with an insulating film composed mainly of aluminum phosphate and colloidal silica, and baked. The properties of the obtained product sheets are shown in Table 8.

The coils satisfying the invention conditions were grain-oriented electrical steel sheets having small coating exfoliation area rates during strong bending and were excellent in coating adhesion.

TABLE 7

| No. | Rare earth metal compound | Content expressed as rare earth metal (Mass %) | Alkali earth metal compound | Content expressed as alkali earth metal (Mass %) | Sulfur-containing compound | Content expressed as S (Mass %) | Ti compound | Content expressed as Ti (Mass %) | Remark |
|---|---|---|---|---|---|---|---|---|---|
| 4-1 | None | 0 | None | 0 | None | 0 | None | 0 | Comparative Example |
| 4-2 | None | 0 | None | 0 | None | 0 | $TiO_2$ | 4 | Comparative Example |
| 4-3 | $CeO_2$ | 1.5 | $SrSO_4$ | 1 | ($SrSO_4$) | 0.37 | $TiO_2$ | 4 | Invention Example |
| 4-4 | $La_2(SO_4)_3$ | 1 | $Ca(OH)_2$ | 2 | ($La_2(SO_4)_3$) | 0.35 | $TiO_2$ | 4 | Invention Example |

Note:

Sulfur compounds in parentheses were added simultaneously as rare earth metal compounds or alkali earth metal compounds.

TABLE 8

| No. | 20 mmϕ exfoliation area rate | 10 mmϕ exfoliation area rate | 5 mmϕ exfoliation area rate | B8 (T) | W17/50 (W/kg) | Sulfide composite formation? | Remark |
|---|---|---|---|---|---|---|---|
| 4-1 | A | C | G | 1.82 | 1.26 | No | Comparative Example |
| 4-2 | A | C | G | 1.84 | 1.20 | No | Comparative Example |
| 4-3 | A | A | B | 1.84 | 1.22 | Yes | Invention Example |
| 4-4 | A | A | B | 1.85 | 1.23 | Yes | Invention Example |

Fifth Set of Examples

Annealing separators like those in Invention Examples 1-8 and 2-6 were used to prepare aqueous slurries of different chlorine ion content. The slurries were coated onto steel sheets like those used in the First and Second Sets of Examples and their application performances were evaluated. NaCl was used to regulate chlorine ion contents. A chlorine ion content indicated as 0 mg/L in Table 9 means the content was below the detection limit. The slurries shown in Table 9 were applied to test sheets (10 cm×30 cm) with a bar coater, and the coating condition after drying of each was visually examined. Application performance was evaluated based on the percentage of the total test sheet surface area that sustained peeling or blotching. From 0% to less than 10% was rated Excellent (E), from 10% to less than 50% was rated Good (G), from 50% to less than 90% was rated Fair (F), and greater than 90% was rated Poor (P). The results are shown in Table 9. It will be noted from the table that application performance was best at a slurry chlorine ion content of not greater than 500 mg/L. The effectiveness of an annealing separator increases with better application performance.

TABLE 9

| No. | Annealing separator | Slurry chlorine ion content (mg/L) | Application performance |
|---|---|---|---|
| 5-1 | 1-8 | 0 | E |
| 5-2 | 1-8 | 5 | E |
| 5-3 | 1-8 | 30 | E |
| 5-4 | 1-8 | 100 | G |
| 5-5 | 1-8 | 500 | G |
| 5-6 | 1-8 | 600 | F |
| 5-7 | 2-6 | 0 | E |
| 5-8 | 2-6 | 2 | E |
| 5-9 | 2-6 | 50 | E |
| 5-10 | 2-6 | 100 | G |
| 5-11 | 2-6 | 500 | G |
| 5-12 | 2-6 | 600 | F |

As demonstrated by the Examples set out above, the coils that satisfied the invention conditions were grain-oriented electrical steel sheets having small coating exfoliation area rates during strong bending and were excellent in coating adhesion.

INDUSTRIAL APPLICABILITY

The present invention overcomes the problem of grain-oriented electrical steel sheet coating exfoliation during strong inward bending at a small radius of curvature in the course of manufacturing a transformer, particularly a wound core transformer, thereby eliminating the drawback that it has not been possible to realize adequate core loss property of the steel sheet material when it is fabricated into a transformer. Thus, by enabling dependable industrial manufacture of high-efficiency transformers in line with market requirements, the present invention makes a substantial contribution to industrial progress.

What is claimed is:

1. Grain-oriented electrical steel sheet excellent in coating adhesion comprising, in mass %, Si: 2 to 7% and having on a surface thereof a primary coating composed mainly of forsterite, wherein the primary coating comprises a compound (A) containing one or more elements selected from the group consisting of Ca, Sr and Ba, at least one rare earth metal, and sulfur, and wherein the grain-oriented electrical steel sheet is formed using AlN as an inhibitor.

2. The grain-oriented electrical steel sheet excellent in coating adhesion according to claim 1, wherein the at least one rare earth metal is one or both of La and Ce.

3. The grain-oriented electrical steel sheet excellent in coating adhesion according to claim 1, wherein the compound (A) is present at least in an interface layer between the primary coating and the steel sheet.

4. A method of producing a grain-oriented electrical steel sheet excellent in coating adhesion formed using AlN as an inhibitor comprising:

preparing a hot-rolled strip using a steel containing, in mass %, C: 0.10% or less, Si: 2 to 7%, Mn: 0.02 to 0.30%, one or both of S and Se: 0.001 to 0.040% in total, acid-soluble Al: 0.010 to 0.065% and N: 0.0030 to 0.0150%, and a balance of Fe and unavoidable impurities;

annealing the hot-rolled strip;

finishing the annealed strip to a sheet of a final thickness by one or more cold rollings or two or more cold rollings with intermediate annealing;

decarburization annealing the cold-rolled sheet;

coating the steel sheet surface with an annealing separator; and drying and finish annealing the coated sheet, thereby producing a grain-oriented electrical steel sheet, wherein the annealing separator is composed mainly of MgO that has a rare earth metal compound content, expressed as rare earth metal, of 0.1 to 10 mass %, an alkaline earth metal compound content expressed as alkaline earth metal, of 0.1 to 10 mass %, and a sulfur compound content, expressed as S, of 0.01 to 5 mass %, and wherein the alkaline earth metal is selected from the group consisting of Ca, Sr and Ba.

5. The method of producing grain-oriented electrical steel sheet excellent in coating adhesion according to claim 4, wherein the annealing separator further contains a Ti compound content, expressed as Ti, of 0.5 to 10 mass %.

6. The method of producing grain-oriented electrical steel sheet excellent in coating adhesion according to claim 4, wherein the steel further contains, in mass %, Bi: 0.0005 to 0.05%.

* * * * *